US009878838B2

(12) United States Patent
Kaimann et al.

(10) Patent No.: US 9,878,838 B2
(45) Date of Patent: Jan. 30, 2018

(54) PACKAGING SYSTEM FOR INSULATION MATERIALS

(71) Applicant: Kaimann GmbH, Hövelhof (DE)

(72) Inventors: Georg J. Kaimann, Hovelhof (DE); Jürgen G. Weidinger, Münster (DE); Hubert Kaiser, Hullhorst (DE)

(73) Assignee: Kaimann GmbH, Hövelhof (DE)

( * ) Notice: Subject to any disclaimer, the term of this patent is extended or adjusted under 35 U.S.C. 154(b) by 42 days.

(21) Appl. No.: 14/578,180

(22) Filed: Dec. 19, 2014

(65) Prior Publication Data

US 2015/0232249 A1 Aug. 20, 2015

(30) Foreign Application Priority Data

Dec. 20, 2013 (EP) ..... 13198937

(51) Int. Cl.

| | |
|---|---|
| ***B65D 51/16*** | (2006.01) |
| ***B65D 81/02*** | (2006.01) |
| ***B65B 11/00*** | (2006.01) |
| ***B65B 55/00*** | (2006.01) |
| ***B65B 7/28*** | (2006.01) |
| ***B21D 22/20*** | (2006.01) |
| ***B21C 23/00*** | (2006.01) |
| ***B65D 21/02*** | (2006.01) |

(Continued)

(52) U.S. Cl.

CPC ..... *B65D 81/02* (2013.01); *B21C 23/00* (2013.01); *B21D 22/20* (2013.01); *B65B 7/28* (2013.01); *B65B 11/00* (2013.01); *B65B 55/00* (2013.01); *B65D 15/24* (2013.01); *B65D 21/023* (2013.01); *B65D 25/28* (2013.01); *B65D 85/70* (2013.01)

(58) Field of Classification Search

CPC .... B65D 81/02; B65D 81/025; B65D 81/027; B65D 25/28; B65D 25/2802; B65D 25/2805; B65D 7/28; B65D 21/023; B65D 21/0234; B65D 21/0235; B65B 11/00; B65B 55/00; B21C 23/00; B21D 22/20

See application file for complete search history.

(56) References Cited

U.S. PATENT DOCUMENTS

| | | | | |
|---|---|---|---|---|
| 123,824 A * | 2/1872 | Hadwin | ..... | B65D 59/06 206/442 |
| 3,696,966 A * | 10/1972 | Herolzer | ..... | B65D 25/00 206/509 |

(Continued)

FOREIGN PATENT DOCUMENTS

| | | |
|---|---|---|
| EP | 0275473 A1 | 7/1988 |
| GB | 2300622 A | 11/1996 |
| WO | 2004092039 A1 | 10/2004 |

OTHER PUBLICATIONS

EP 13198937.8 filed Dec. 20, 2013 Extended European Search Report dated Jun. 2, 2014.

*Primary Examiner* — Steven A. Reynolds
*Assistant Examiner* — Javier A Pagan
(74) *Attorney, Agent, or Firm* — Rutan & Tucker, LLP

(57) ABSTRACT

The present invention relates to a packaging system to enclose, protect, store and transport insulation materials, with the possibility to pack with no to low or high compression, to provide ventilation when packaged and to enable indoors or outdoors storage, exhibiting easy and economic as well as ecologic application, storage and transport as well as easy opening, the manufacture of such packaging and the use of such packaging.

14 Claims, 13 Drawing Sheets

(51) Int. Cl.

| | |
|---|---|
| ***B65D 25/28*** | (2006.01) |
| ***B65D 8/00*** | (2006.01) |
| ***B65D 85/00*** | (2006.01) |

(56) References Cited

U.S. PATENT DOCUMENTS

| | | | | | |
|---|---|---|---|---|---|
| 3,955,705 | A * | 5/1976 | Dubois | B65D 11/06 | 206/509 |
| 4,074,827 | A * | 2/1978 | Labe, III | B65D 51/28 | 206/217 |
| 4,535,587 | A | 8/1985 | Rias | | |
| 4,909,392 | A * | 3/1990 | Williams | B65D 21/0202 | 206/509 |
| 2005/0157961 | A1 | 7/2005 | Langston | | |
| 2012/0285951 | A1 * | 11/2012 | Cavalcante | B65D 11/1833 | 220/6 |

* cited by examiner

Fig. 5
Fig. 5a)
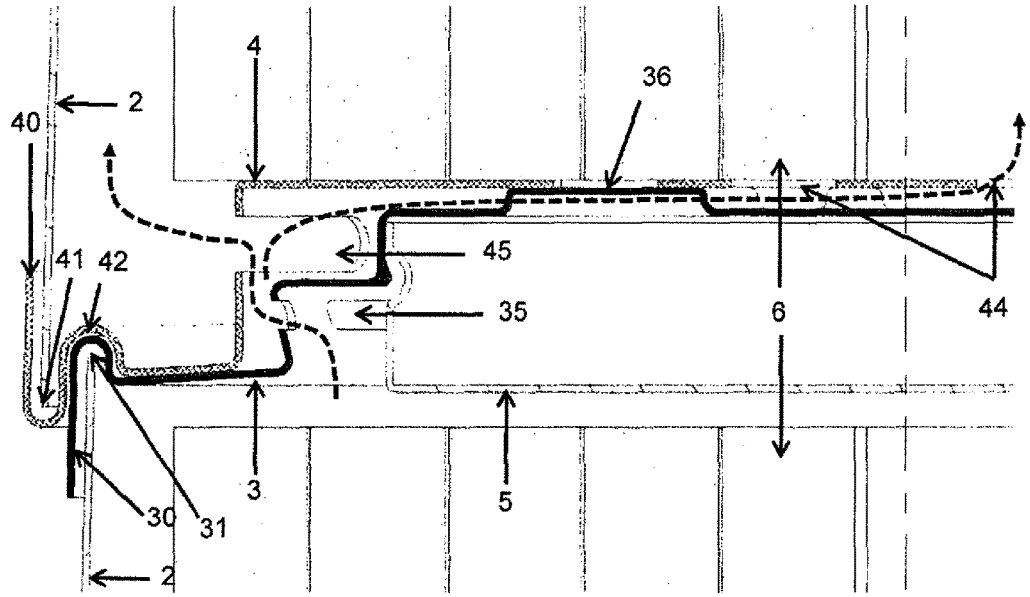
Fig. 5b)
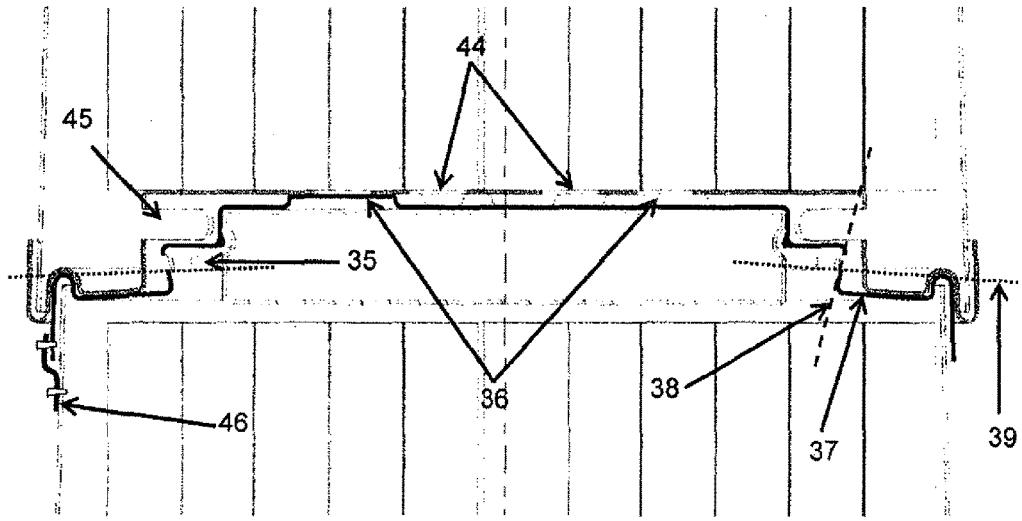

Fig. 9a)
Fig. 9b)
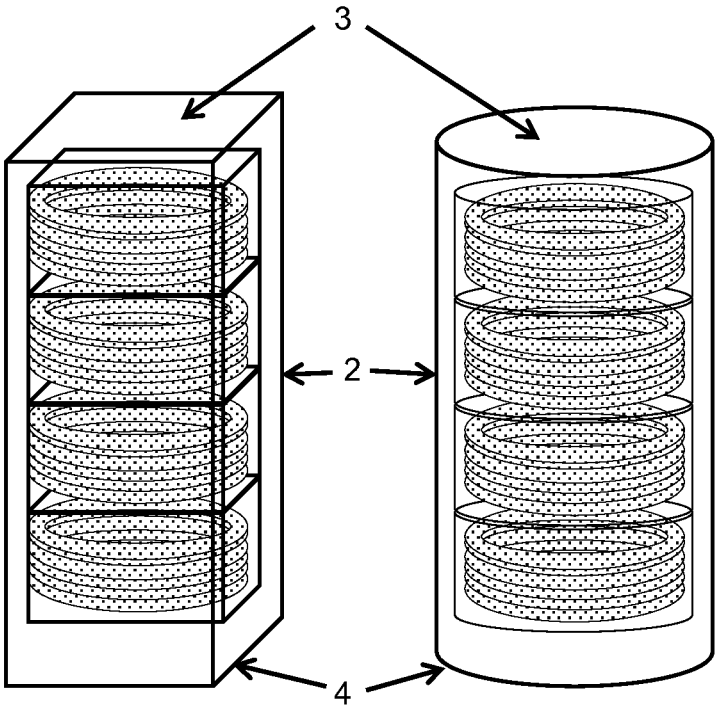
Fig. 9c)
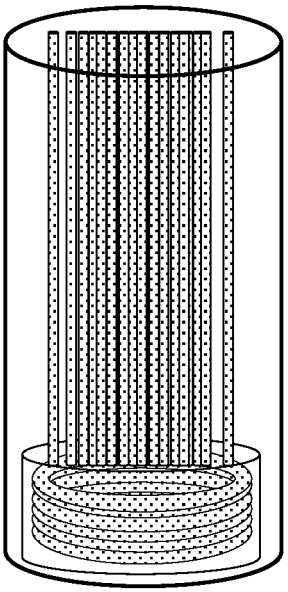

PACKAGING SYSTEM FOR INSULATION MATERIALS

PRIORITY

This application claims the benefit of priority under 35 U.S.C. § 119 to EP13198937, filed Dec. 20, 2013, which is incorporated by reference in its entirety into this application.

BACKGROUND

Field of the Invention

The present invention relates to a packaging system to enclose, protect, store and transport insulation materials, with the possibility to pack with no to low or high compression, preferably to provide ventilation when packaged and to enable indoors or outdoors storage, exhibiting easy and economic as well as ecologic application, storage and transport as well as easy opening, the manufacture of such packaging and the use of such packaging.

Description of the Related Art

Insulation materials, no matter if fibre or polymer foam based, show porous structures being sensitive to humidity or water intake (which would increase the thermal conductivity and thus decrease or even destroy the insulation effect). Additionally, as entrapped air or cell gas is the best insulator and not the surrounding fibre or foam, low densities are always targeted, however, leading to huge volume per weight unit in storage and transport. Some attempts have been made to improve the packaging of voluminous, rather soft insulation materials, such as in U.S. Pat. No. 3,587,201 A, where tubular shaped insulation is compressed by means of two box parts, similarly to DE 298 25 177 U1. WO 2006/102893 A1 discloses the wrapping of laminar (mat shape) insulation by foils or films, similar to DE 602 04 392 T2/EP 1 283 181 A1, where the packaging foil can also be used as a vapour barrier when mounting later on. In GB 1 418 882 A, a wrapped insulation is reduced in volume by applying vacuum. EP 0 275 473 A1 also claims the use of vacuum using a construction where a bundle of insulation material is wrapped with a top and bottom "plate" being mounted and vacuum being applied through the perforated bottom plate, and then the whole construction is wrapped for airtight sealing. U.S. Pat. No. 3,889,444 A, eventually, will use vacuum on a rolled insulation mat packaged into an envelope with sausage like shape. EP 0 592 314 A1 describes a process where insulation blankets in tubular form are put together in a way that a second layer of blankets is put on top of a first layer, then the whole construction is wrapped with foil and in parallel the pallet for transport is integrated. EP 0 704 384 A2 is claiming a group of six insulation material rolls, each of them wrapped in packaging to be compressed and fixed, which is put around a seventh central roll eventually forming a roughly hexagonal outer shape which is then again being wrapped. EP 2 646 340 A2 finally claims an insulation material being rolled an equipped with a rather stable wrapping comprising a handle film; however, there is no moisture or weathering protection.

All a.m. methods will lead to compression and/or deformation of the insulation goods and therefore would render their insulation properties worse in any case, as no insulation material will fully recover once compressed. Same is provided—less, but still—in e.g. US 2008/115460 A1, where mat-like insulation products are rolled, fixed by strips—which leads to inhomogeneous deformation—and then wrapped by a bag-like packaging. Additionally, as also valid for almost all a.m. inventions, the packaging is airtight and does not provide additional stability. US 2013/067861 A1 discloses a solution where several rolled mats are compressed together by a foil wrap, with an option to put a top on the packaging to protect the mat bundle from the ambience. However, neither the top nor the foil wrap are intended to represent a stable, self-standing packaging, and ventilation is almost entirely suppressed as the top is closing quite tightly. Same is valid for e.g. US 2013/067861 A1 or the already mentioned US 2008/115460 A1 (where at least vapour permeability is claimed).

All a.m. prior art is lacking in either stability (and/or stackability), weather resistance/weatherability (and/or outdoor storage possibilities), ventilation performance, variability of size, geometry and compression ratio, or in most cases even shows combinations of such disadvantages.

SUMMARY OF THE INVENTION

A major object of the present invention thus is to provide a packaging system not showing the above mentioned deficiencies but exhibiting stability for stacking the packed goods, and also to protect them mechanically from compression or damage, weatherability to allow transport and storage, as an optional feature ventilation to remove smell from the insulation goods but also to prevent anaerobic processes (e.g. of reversion, degradation), easy packaging and opening, and economic and ecologic production, i.e. low manufacturing complexity and costs as well as space-saving, energy-saving and ecologic sustainability and optionally reusability and/or recyclability.

It is found that such system not showing the above mentioned disadvantages can be made comprising a preferably foil-like mantle around the insulation material stabilized by specially designed top and bottom plates with the respective grooves and protrusions or rims, as well as optional ventilation openings exhibiting special design either.

The present invention provides a packaging system comprising the features of independent claim 1. Besides the positive effects mentioned before, the rims in the top and bottom plate guide, fix and stabilize the mantle horizontally and vertically so that a highly stable packing system is established, wherein—in a preferred embodiment—the mantle is additionally pressed against the insulation material to be accommodated within the packing system. The declination on the top plate provides water drain properties.

According to a preferred embodiment, the top plate and the bottom plate comprise at least one opening to provide forced ventilation of the inside of the packaging. Preferably, openings in the top plate and in the bottom plate are arranged neighboured in a way that the openings are not blocked and ventilation is ensured when packing systems are stacked.

Preferably, the mantle and top and bottom plates are connected by adhesives, mechanical connection or welding to form a closed packaging. This packaging can be easily opened due to the fact that the connections are sufficiently easy to unleash/break and/or do not reach over the entire distance to be connected.

Further, the outer contour is in one embodiment cylindrical or of cone or of reverse cone shape. Thereby, a solid device for accommodating insulation material is provided.

The material for the mantle and top and bottom plates is in particular chosen from massive and/or expanded recyclable materials, preferably from massive and/or expanded thermoplasts, especially preferred from expanded and/or massive polyolefins and/or thermoplastic biopolymers and/or polyalkylidene terephthalates.

According to another embodiment, at least the top plate has a declination by dome shape, as well as distance keepers on top. The dome shape is suitable for water drain and stability purpose. The distance keepers ensure a gap between two packaging systems.

Preferably, an insert is arranged at least on the side of the top plate facing the interior of the packaging system. Thereby, a closed space may be created for accommodating additional items.

For example, printed media is arranged in a closed space created by the use of the insert. The printed media is, thereby, disposed with the packaging system containing e.g. the insulation material, and cannot get lost.

According to another embodiment, an adhesive product for insulation materials is arranged in a closed space created by the insert. The adhesive product can be used e.g. for seam sealing when removing e.g. the insulation material accommodated in the packaging system.

Further, a handle and/or handle bar is provided at the packaging system which facilitates handling of the packing.

According to a preferred embodiment, the mantle has a minimum thickness of 100 micron and the top plate and/or bottom plate has a thickness of at least 150 micron at their thinnest point. The maximum thickness of the mantle is 5 mm and the maximum thickness of top and/or bottom plates is 10 mm.

Preferably, the individual parts of the packaging system according to the present invention are made by extrusion, foil blowing, deep-drawing, casting or moulding, preferably by extrusion of the mantle and moulding of the top and bottom plates. Thereby, the packaging system can be obtained in a cost-effective manner.

The present invention further refers to a method according to claim 14 and a use according to claim 15, which may be combined with preferred features outlined above.

BRIEF DESCRIPTION OF THE DRAWINGS

Hereinafter the present invention will be explained in a non-limiting manner by way of example by means of advantageous embodiments with reference to the accompanying drawings wherein FIG. 1 shows a perspective cross section view of a first embodiment of a packaging system 1 according to the present invention, wherein

- 2 is an outer mantle or wrapping (here shown in a cylindrical embodiment), hereafter called "foil";
- 3 is a top plate (here shown in a circular embodiment) with designs 30-31 for fixing and guiding/stabilizing the foil 2, openings 35 and distance keepers 36 for enabling ventilation;
- 4 is a bottom plate (here shown in a circular embodiment) with designs 40-42 for fixing and guiding/stabilizing the foil 2 and openings 44-45 for ventilation;
- 5 is an optional insert to create closed space.
- The assignments "top plate" and "bottom plate" or "top" and "bottom" are only provided for better clarity; if required, all embodiments can be used also in inversed state, i.e., "top down" and/or "bottom up".

Figure 2A:
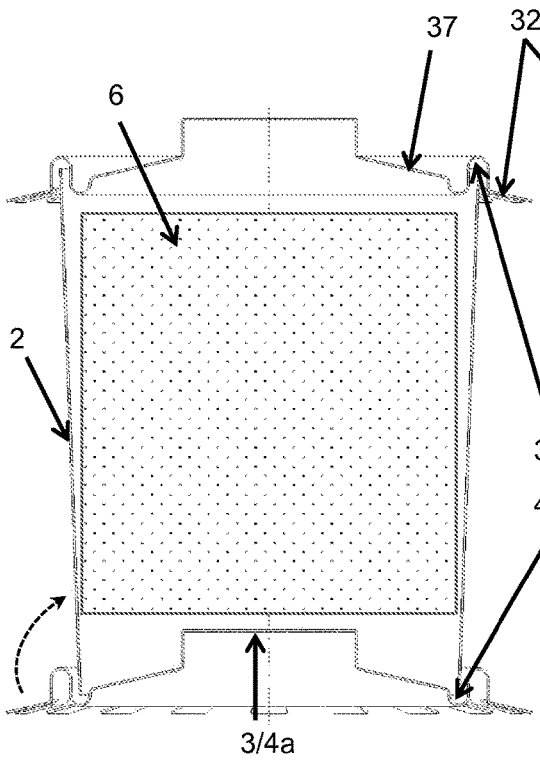
Figure 2B:
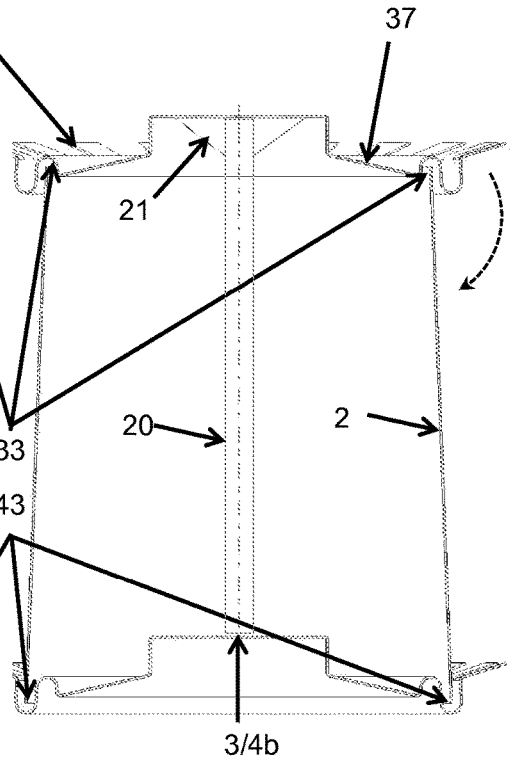
Figure 2C:
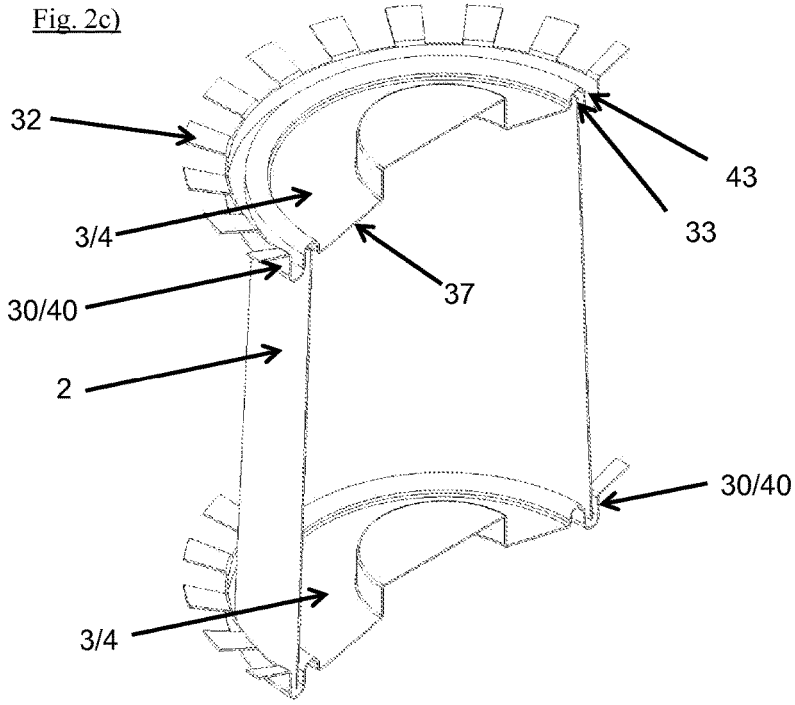

FIG. 2 shows schematic views of a another embodiment of a packaging system according to the present invention, wherein FIG. 2*a* and FIG. 2*b* show cross-sections of the possible embodiment wherein the top and bottom plates 3/4 are of identical shape, respectively, enabling to go for a cone shape (FIG. 2*b*) or reverse cone shape (FIG. 2*a*) of the wrapping 2; FIG. 2*c* shows a perspective cross-section view of the same embodiment. FIG. 2 also demonstrates the possibility to use extensions 32 of the plate rims 30/40 for fixing and stabilizing the foil 2, as well as the declination 37 of at least the top plate to ensure water drain in case of the packaging being exposed to rain or snow.

Figure 3:
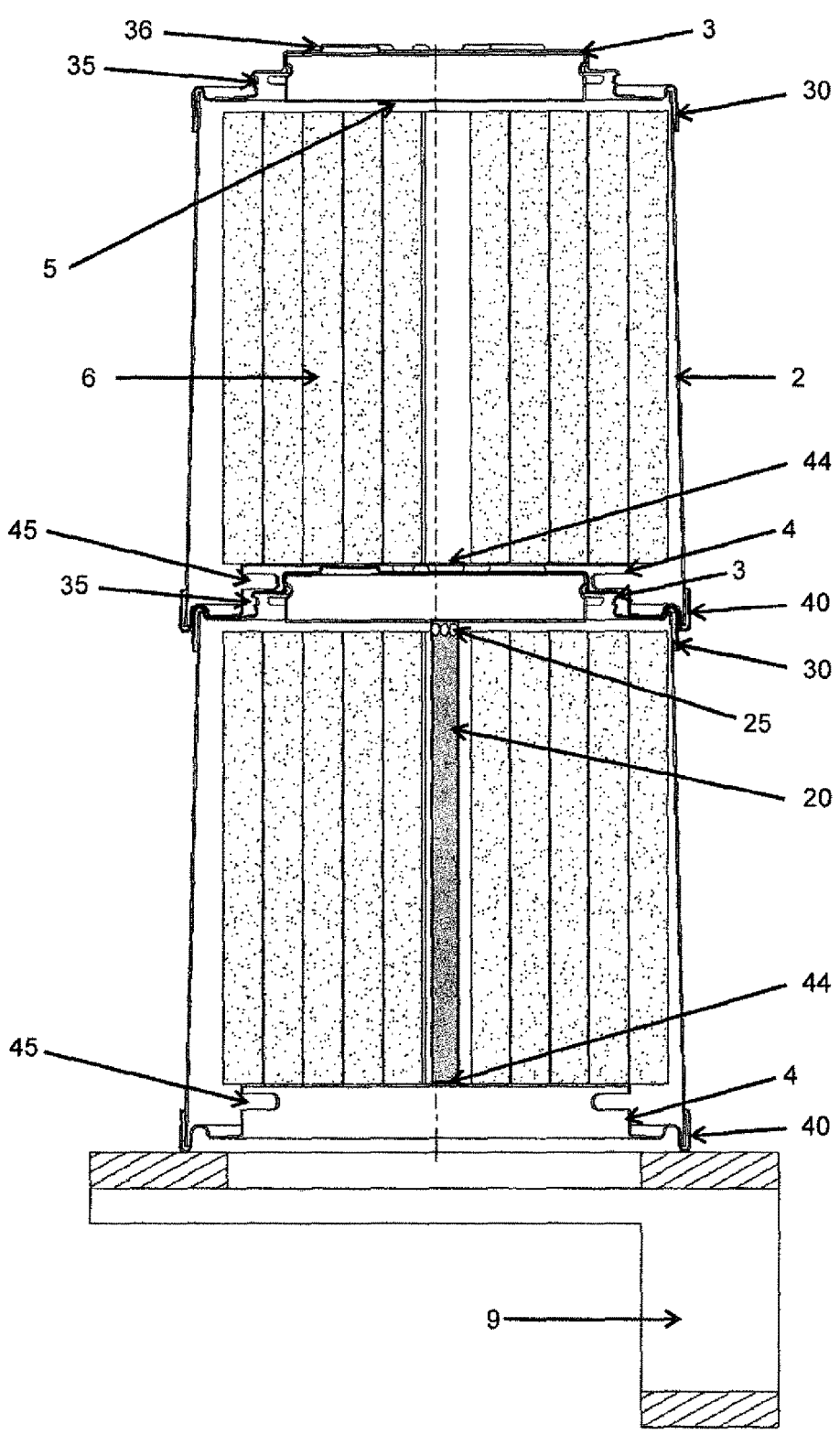

FIG. 3 shows a cross section of a another embodiment of a packaging system according to the present invention, wherein two packaging systems 1 are stacked showing a real-life situation of packaged insulation material 6 on a pallet 9 with the bottom and top plates 3,4 providing safe stacking.

Figure 4:
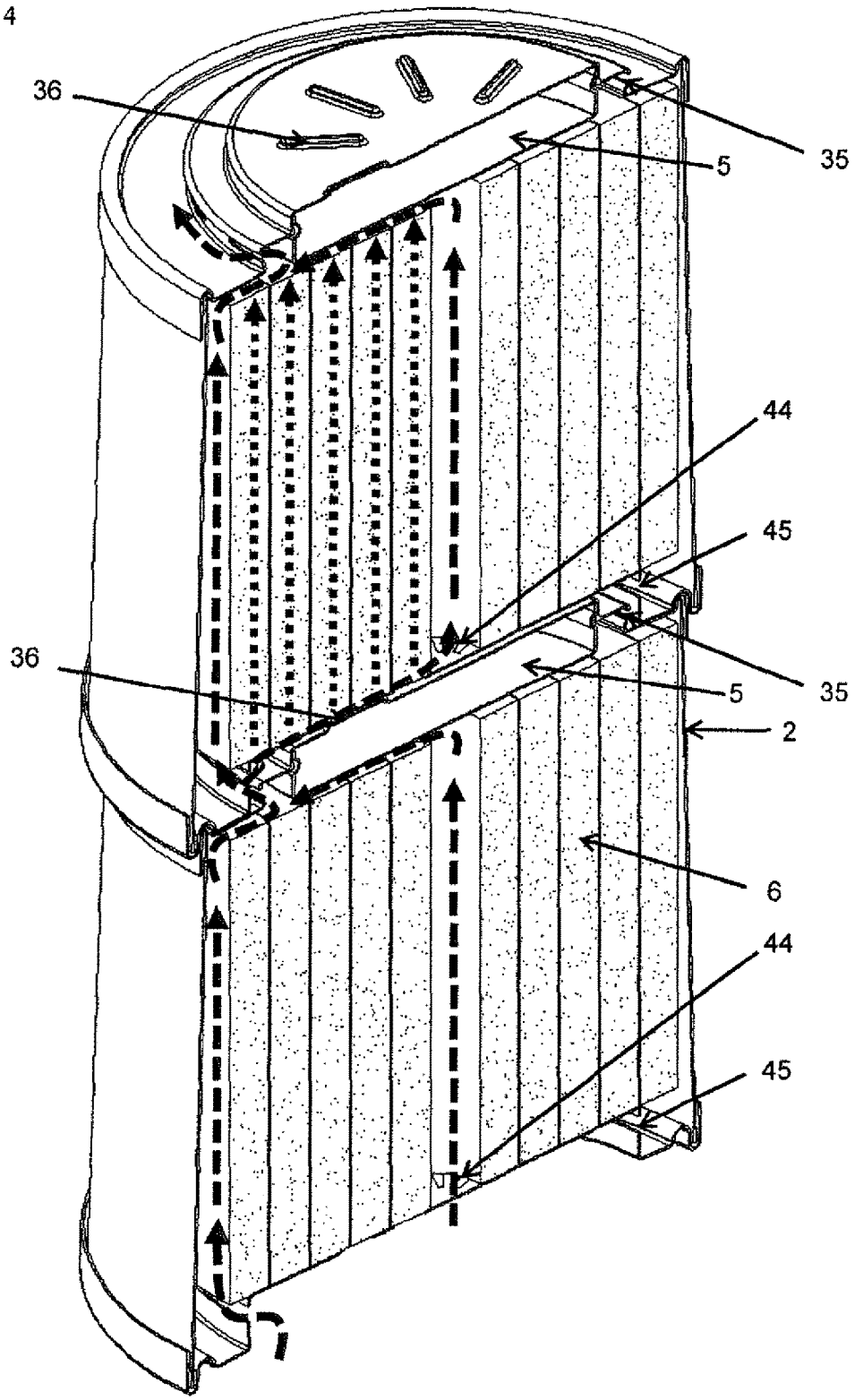

FIG. 4 shows a perspective cross section view of two packaging systems 1 being stacked and demonstrates the chimney-like (forced) ventilation taking place inside the packaging systems.

Figure 5C:
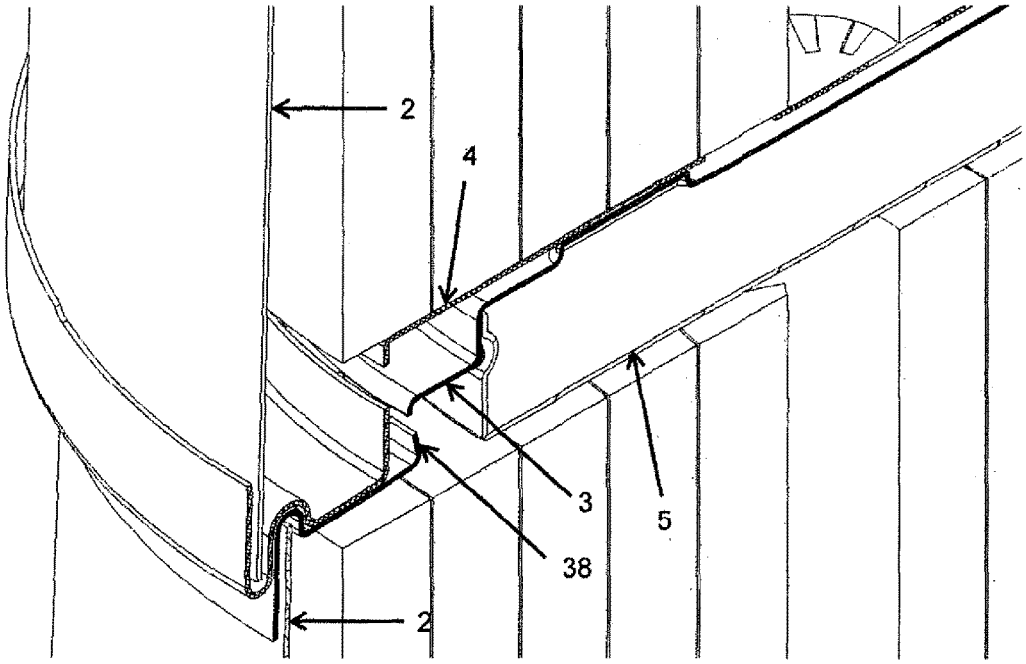

FIGS. 5*a-c* show cross section details of a possible embodiment of the top/bottom plate contact zone of two stacked packaging systems demonstrating the stabilization of stacked packaging units by rims/grooves 30,31/40-42 as well as the ventilation through a possible embodiment of openings 35,44,45 and distance keepers 36. FIG. 5*b* demonstrates how weatherability (optimal water drain) is achieved by using a declination 37, an overhang or cantilever 38, and a virtual declination 39 between the lower edge of the ventilation openings 35 and the upper edge of the groove/rim 31.

Figure 6A:
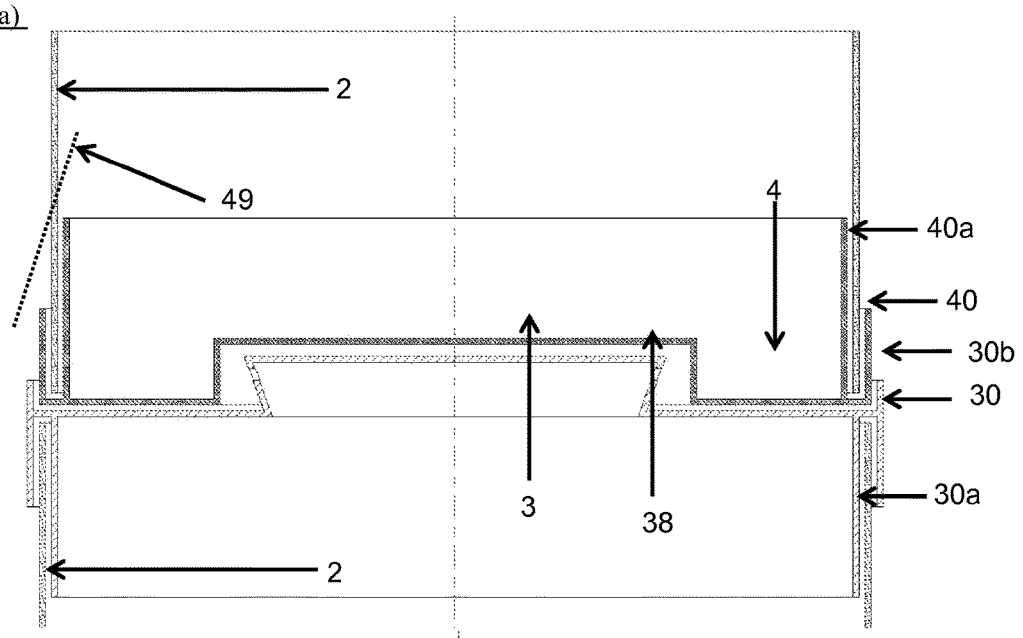
Figure 6B:
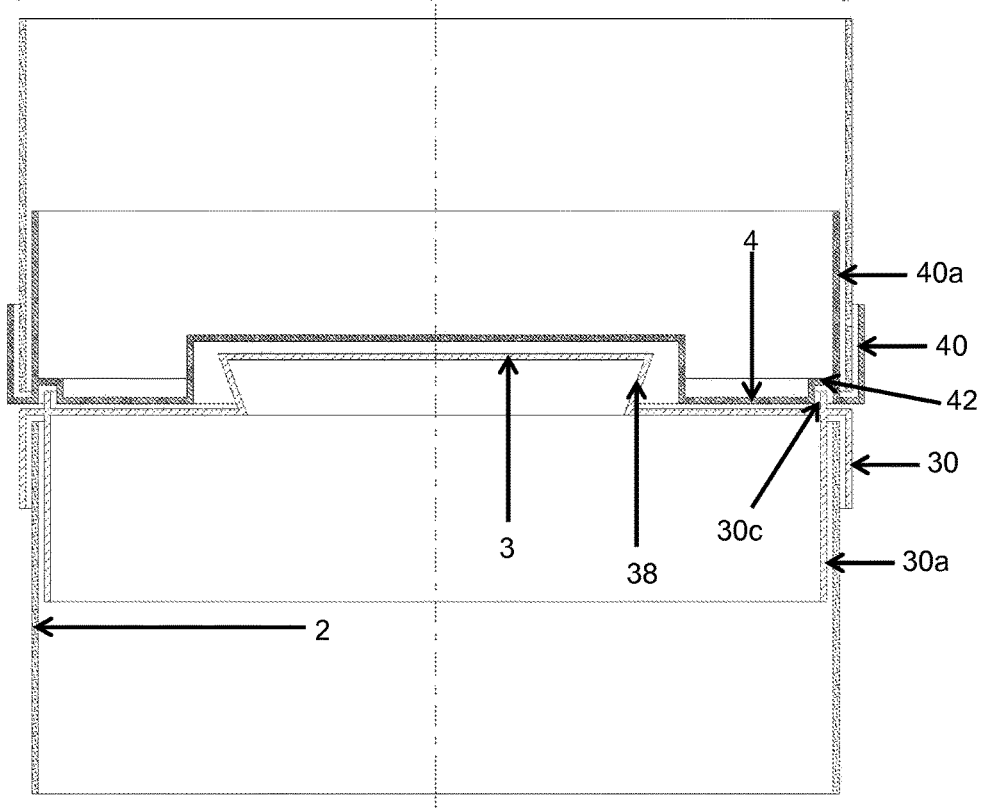

FIGS. 6*a* and 6*b* show schematic cross-section views of another embodiment of the top/bottom plate contact exhibiting high stability of the stacked packaging units through various designs of rims and/or grooves 30,30*a*,30*b*/40,40*a*, 42.

Figure 7:
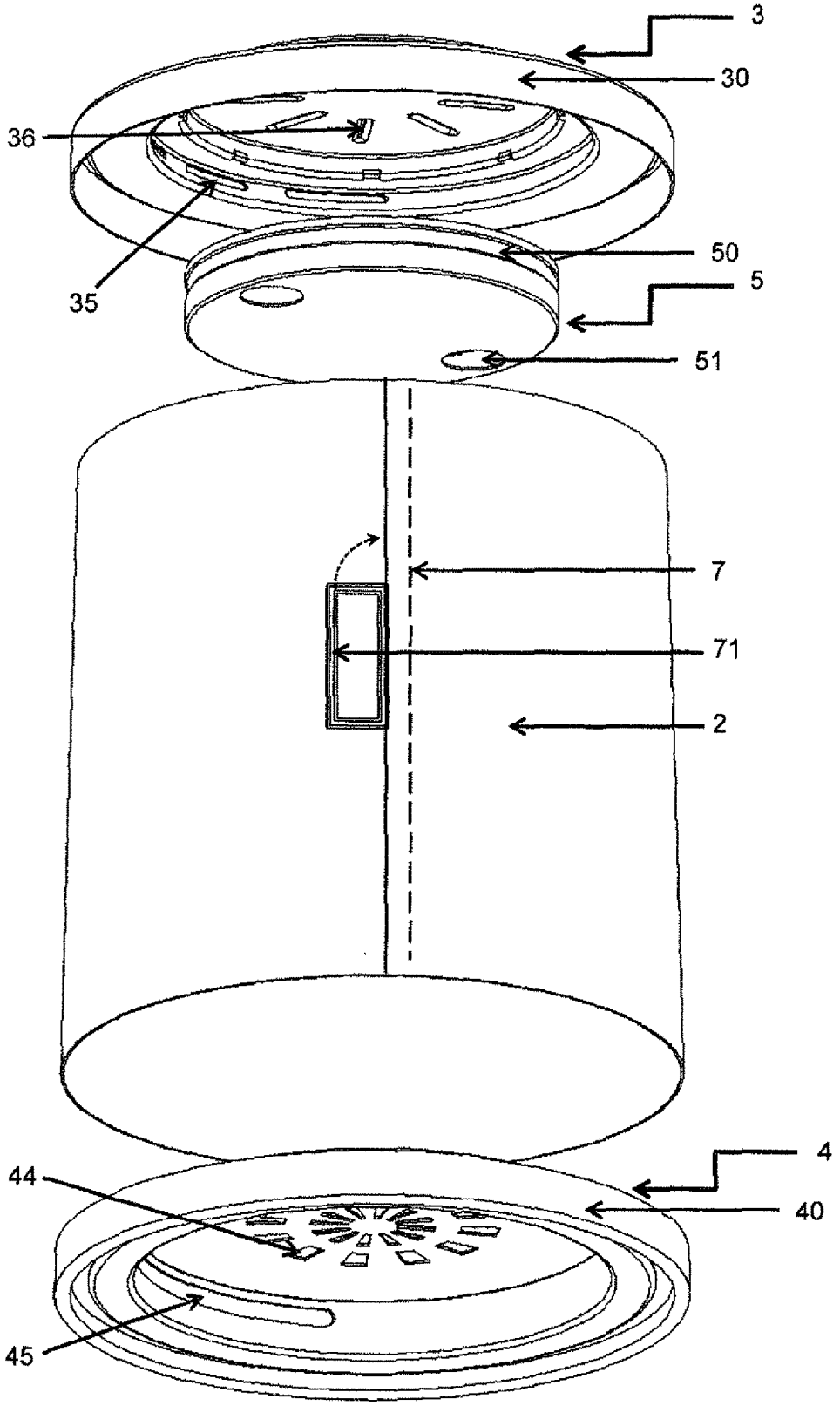

FIG. 7 shows an exploded view of another embodiment of a packaging system according to the present invention demonstrating in detail how a closed space (e.g. for labels, booklets, service products) can be created by using an insert 5 snapped/locked/mounted into at least the top plate 3; and one possibility of closing the wrapping 2 by partial gluing and/or welding 7.

Figure 8:
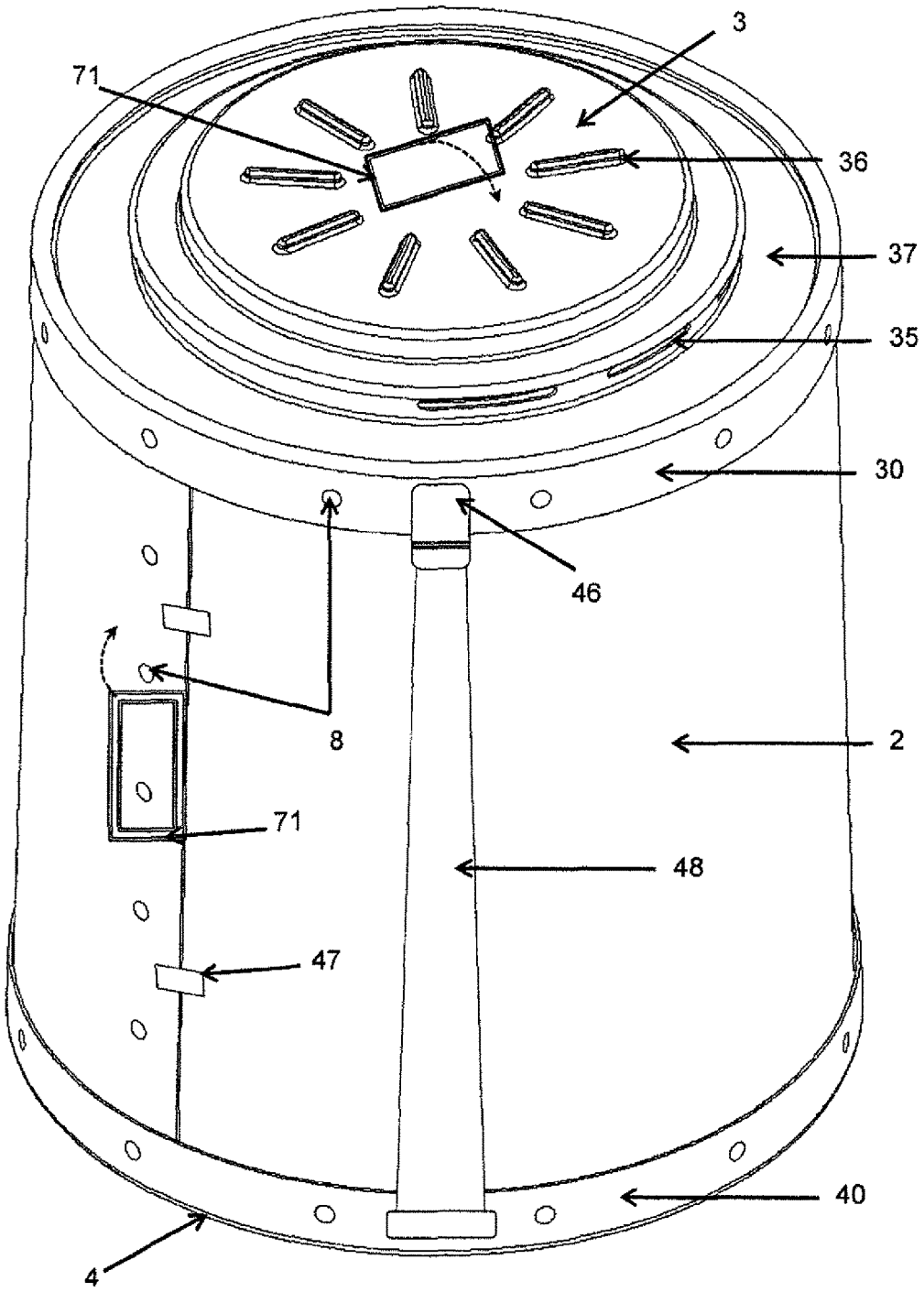
Figure 10A:
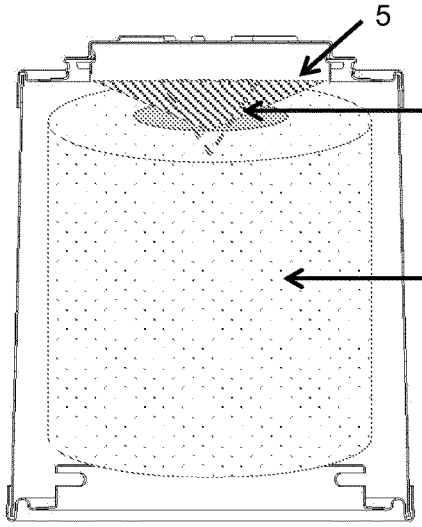
Figure 10B:
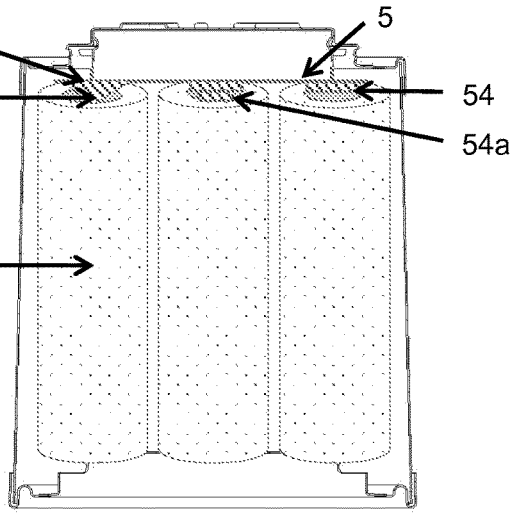
Figure 10C:
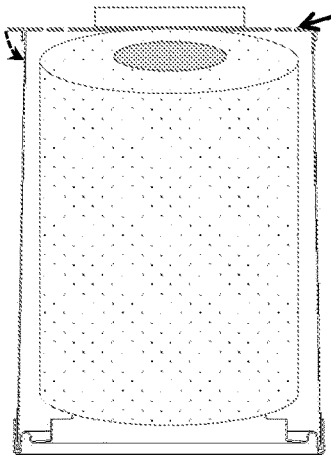
Figure 10D:
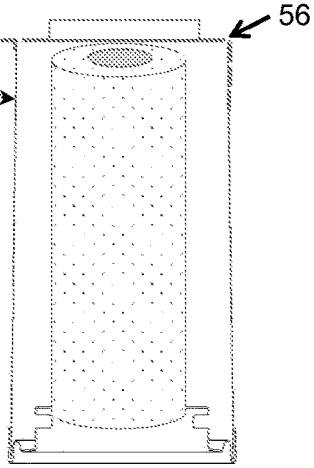

FIG. 8 shows a perspective view of another embodiment of a packaging system according to the present invention showing a single packaging unit in an outside view another possibility of closing the wrapping 2 by partial gluing and/or welding at spots 8.

FIGS. 9*a*, 9*b*, and 9*c* show schematic views of another embodiment of a packaging system according to the present invention showing different possibilities for storing goods with their own packaging or of combinations of goods.

FIGS. 10*a*, 10*b*, 10*c*, and 10*d* show schematic cross sections of another embodiment of a packaging system according to the present invention showing different possibilities for safely storing and transporting tubular shaped insulation materials per single or multiple item.

Figure 11:
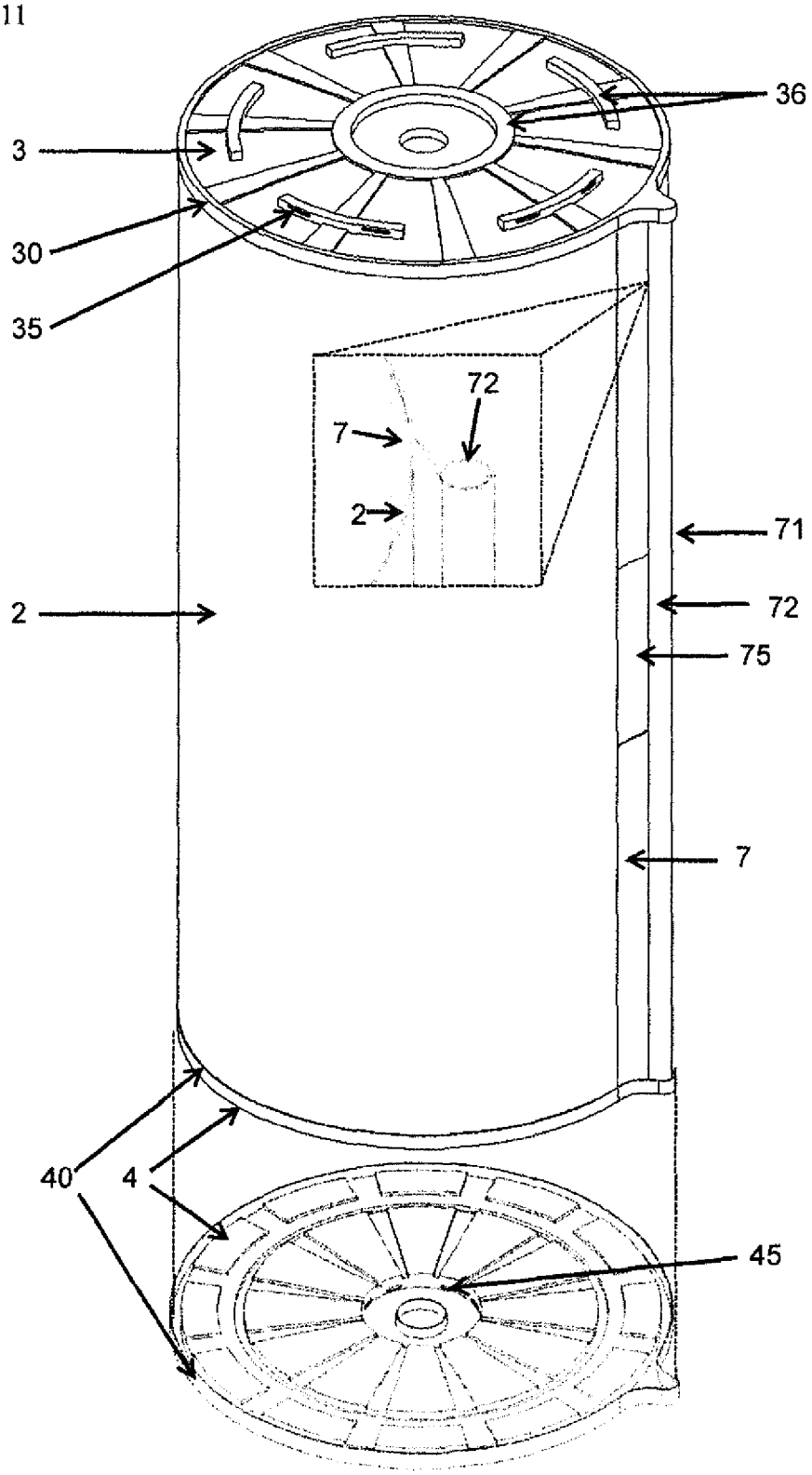

FIG. 11 shows a perspective view of another embodiment of a packaging system according to the present invention demonstrating how a very simple, deep-drawing friendly, but still good weather resistant and stable combination of foil wrapping 2 and top and bottom plates 3 and 4 can be realized, and how handles 71 can be formed by rolling the foil wrapping 2, and how these handles can be integrated into the top plate 3 and bottom plate 4 to obtain a very light, but optimally stable packaging.

Figure 12A:
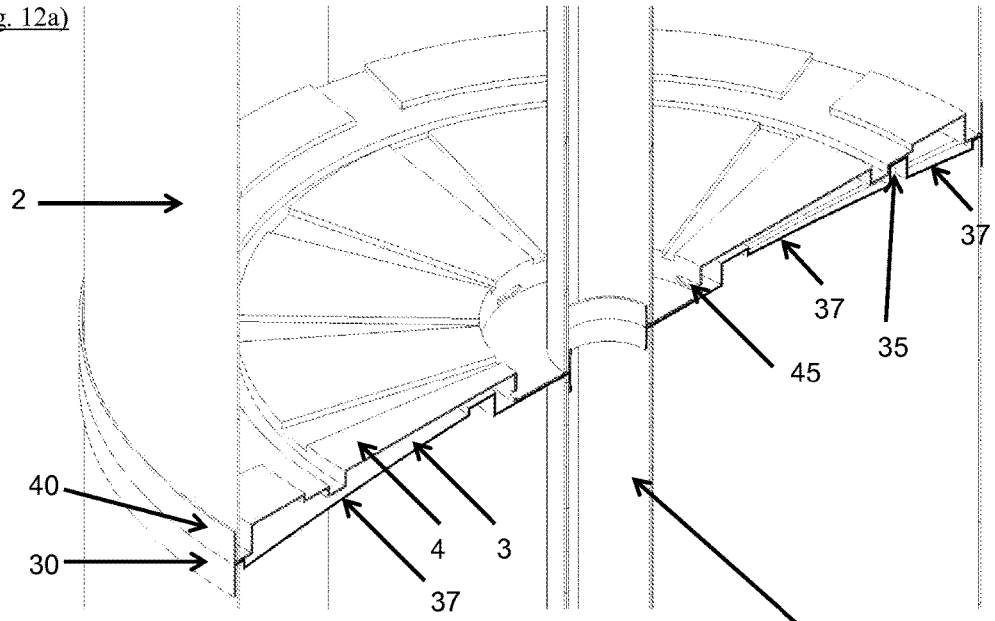
Figure 12B:
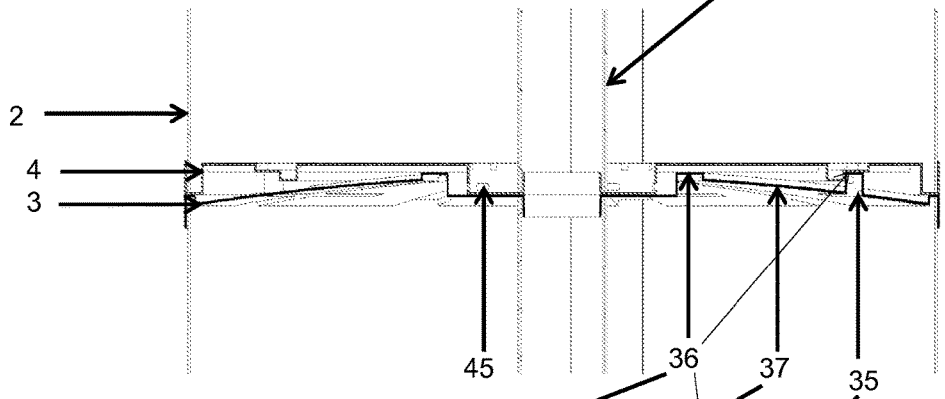
Figure 12C:
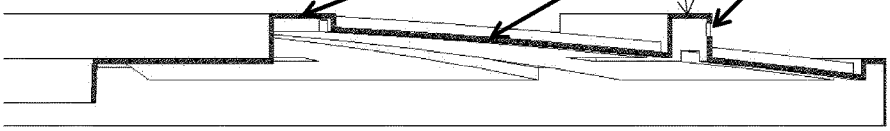

FIGS. 12*a*, 12*b*, and 12*c* show cross section details of another embodiment of the present invention where two packaging systems are stacked and how the top/bottom plate contact zone of two stacked packaging systems fit into each other still enabling ventilation through another embodiment of openings 35 and 45 and distance keepers 36.

DETAILED DESCRIPTION OF SELECTED EMBODIMENTS

Hereafter, preferred embodiments of the present invention are described with reference to the drawings. Single features of the following embodiments or modifications thereof may be combined with features of other embodiments or modifications so as to form further embodiments.

A packaging system 1 according to the present embodiment comprises a foil/wrapping (mantle) 2 connecting a top plate 3 and a bottom plate 4.

The packaging system 1 as a whole can be of any outer shape, such a circular/round/oval, rectangular/square, pentagonal/hexagonal/polygonal etc., whereas round or rectangular shape is preferred, and round shape is especially preferred, leading to a cylindrical form of the foil 12.

The material for the packaging system 1 comprises at least one layer of metal or fibre (paper, carton, tissue) based material or polymer (thermoplast, TPE, thermoset) based material, or any combinations thereof. Preferred are paper or thermoplast based materials, especially preferred are thermoplasts, such as polyolefins (PE, PP etc.), styrenics (PS, ABS, SAN, SEBS etc.), polyesters (polyurethanes, polycarbonate, polyalkylidene terephthalates like PET, etc.), polyethers (POM, PEEK etc.), polyamides, polyimides, halogenated polymers (PVC, CPE, CSM etc.), biopolymers (polylactides PLA, cellulose based polymers, thermoplastic starch TPS, polyhydroxyalkanoates, such as PHB, etc.), PMMA, or any combinations thereof. The materials can be massive or expanded to foam or sponge, or any combinations thereof. Polymer based materials may contain UV and/or IR stabilizers.

The foil 2 comprises at least one layer of any of the a.m. materials, preferably polymer or paper based material, especially preferred thermoplast based material. For good weathering and outdoor resistance waterproof coated corrugated paper or UV stable/stabilized thermoplasts are preferred.

The foil 2 can be fixed in the packaging system 1 in a way that it is fully cylindrical, but preferably in a way that it is cone or reverse cone like, see FIGS. 2*a* and *b*. Both embodiments are advantageous for the applications, on the one hand due to improved ventilation—as there is always a gap between the foil 2 and the insulation material 6 to be packaged—, on the other hand due to the fact that the insulation material 6 is not fully compressed, but can be fixed and transported either by holding it on its top (cone shape, FIG. 2*b*) or by holding it on its bottom (reverse cone, FIG. 2*a*), the latter embodiment even allowing to transport the insulation material 6 literally levitating, as it is not necessarily touching the bottom plate 3 or its variations (see FIG. 2*a*).

The foil 2 can comprise openings for ventilation (preferably on its top when being used in the reverse cone configuration), reinforcing structures, such as ribs, corrugated structures etc. It can be labelled or printed or showing embossed structures.

The foil 2 can be monolithic/seamless or can comprise a seam and/or an overlap. It can comprise structures 47 for closing and/or opening it, see FIG. 8, such as hinges, hooks, buttons, latches, or the like, or any combinations thereof. These structures 47 for opening/closing can be used to connect the foil 2 at its overlap and/or to connect the foil 2 to the top plate 3 and/or the bottom plate 4.

The foil 2 can comprise battlement like recesses on its top and/or bottom edge to fit into respective slots in accordingly designed top and/or base plates. The protrusions resulting from the grooves 31 of the top plate 3 then would not run over the full perimeter of the top plate 3 but would be interrupted, as the battlement lap configuration of the foil 2 would require less slot space than a continuous edge. As a result, water e.g. from rain could run off the top plate 3 even more easily as with the "virtual declination" 39, see FIG. 5*b*, which is described further below.

The top plate 3 and the bottom plate 4—and their variations 3/4,3/4*a*,3/4*b*—comprise at least one layer of any of the a.m. materials each, preferably polymer or paper based material, especially preferred thermoplast based material. For good weathering and outdoor resistance waterproof coated corrugated paper or UV stable/stabilized thermoplasts are preferred.

The top plate 3 and the bottom plate 4 are designed in a way to fit one into each other to enable the packaging system 1 to be stacked infinitely in a slot and key or tongue and groove manner. For this purpose the plates 3 and 4 comprise grooves and protrusions 31,41,42, see FIGS. 1 and 5; 33,43 see FIG. 2, where a groove on one side of the plate may result in a protrusion on the other side of the plate) which fit into each other. As long as this fitting is provided, the top and bottom plates can be of significantly different shape, such as in FIGS. 1 and 7, or of identical shape, such as in FIG. 2 for 3/4, 3/4*a*,3/4*b*.

Figure 1:
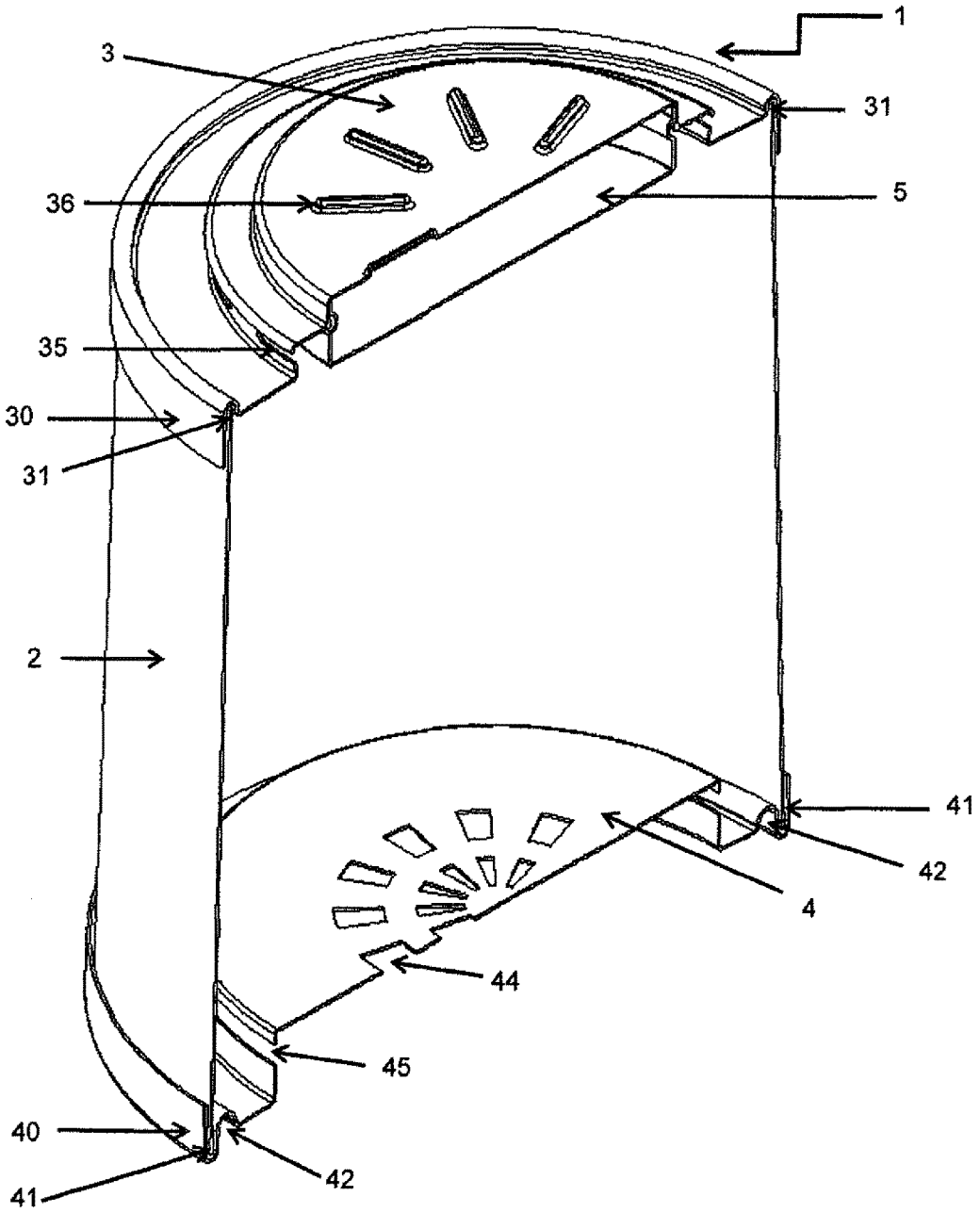

For guiding, fixing and stabilizing the foil 2 both top and bottom plate 3,4,3/4,3/4*a*,3/4*b* can comprise rims—30, 30*a*, 30*b*, 40, 40*a* as in FIGS. 1 and 5; 30*a*,40*a* as in FIG. 6—that can be connected to the foil 2 by means of adhesion (glue, tape etc.) or welding (UHF, temperature etc.) or mechanically (by rivets, buttons, zip fasteners, hook and loop fasteners etc.) over the full distance or preferably only partially—as shown for an interrupted welding line 7 in FIG. 7 or for welded spots or rivets 8 in FIG. 8—for facilitating opening of the packaging. The rims 30, 30*a*, 30*b*, 40, 40*a* can comprise flaps or lugs 32, see FIG. 2, that can be turned down or up to be fixed to the foil 2 to provide even higher stabilization effect.

Both top and bottom plate 3, 4, 3/4, 3/4*a*, 3/4*b* can comprise openings 35, 44, 45, see FIGS. 1, 3, 4, 5 and 7, for ventilation of the content of the packaging. The resulting ventilation effect in a single packaging system 1 or in stacked packaging systems is forced ventilation (so-called "chimney effect"), see FIGS. 4 and 5*a*.

As the openings 35 and 45 are designed in a way that they are neighboured in stacked state of two or more packaging systems 1 and as the distance keepers 36 ensure that there is an airflow also to the openings 44, one can describe the total airflow in the following way: fresh air is entering from the bottom (e.g. through the pallet 9, see FIG. 3) into the openings 44 and 45 of the bottom plate 4, see FIG. 4, then ascending at least between foil 2 and the packaged insulation material 6, but also through the insulation material 6—especially when the insulation material 6 is fibrous and/or porous or cellular and/or tube-like, as is indicated in the upper left part of FIG. 4—, then leaving the first packaging system 1 through the openings 35 of the top plate 3. The air then can move through openings 45 of the bottom plate 4 of the next packaging or through the gap between the top and bottom plates 3, 4 provided by the distance keepers 36 into the central openings 44 of the bottom plate 4 of the next packaging, see FIG. 5*a*, and so on. Finally, the air will escape through the opening 35 of the most upper top plate 3 of each stack.

To provide weatherproof properties to the packaging system 1 it is essential—besides UV, ozone and general physical and chemical stability, as mentioned above—to exhibit safe water drain properties. This needs to be provided without hampering the ventilation performance or the handling/stacking properties and is achieved in the present invention by a declination 37 being applied to at least the top plate 3 (see FIGS. 2 and 5*b*).

The design of the declination 37 is carried out in a way that water drain is always ensured because the uppermost part of outer rims or protrusions 30, 31 is always lower than the lowest edge of an opening for ventilation, e.g. 35, which is shown in FIG. 5*b* by a virtual declination line 39. To ensure that there is also no penetration by water through driving rain, an overhang or a cantilever part 38 is applied at the section of at least the top plate 3 where the openings 35 are located (see FIGS. 5*b* and 6) and/or the openings 35 are arranged in a way that they face "downhill" the declination 37 (see FIG. 11) and are shielded from draining off water by e.g. being placed into an uncontinuous protrusion or rib.

The uppermost part of the top plate 3 where the distance keepers 36 are located can also comprise a declination, resulting in a slight dome shape, which is also helpful to prevent the uppermost part of the upper plate 3 being deformed of compressed when stacking the packaging systems 1, as such corrugation could have a negative effect (reducing the gap between the plates) on the ventilation through the openings 44.

The distance keepers 36 may comprise a simple complete or interrupted protrusion preferably following the outer shape of the packaging 1—see FIG. 11—and/or may comprise preferably radial bars or ribs, see FIG. 1.

The top plate 3 and/or the bottom plate 4 can be connected to the foil 2 by hinges, latches etc.—46, see FIG. 5*b*—to allow easy opening and closing of the packaging system 1, or the plates may be connected to each other by a separate connection—e.g. a bar or pillar 48, see FIG. 8—not necessarily being integral part of the foil 2, where again at least the top plate 3 may show a hinge 46 together with the connection 48.

One of the top/bottom plate 3 or 4, preferably the top plate 3, can comprise a closed space generated by an insert 5, see FIGS. 1 and 7, which is fixed to the plate by means of adhesion (glue, tape etc.) or welding (UHF, temperature etc.) or mechanically (by buttons, zip fasteners, hook and loop fasteners, snap-lock closure etc.) over the full distance or only partially. Preferred are fixing systems that allow re-opening, such as snapping a groove or rim 51 of the insert 5 into an undercut in the plate (see FIG. 7). The insert 5 can also be fixed to the plate by a hinge and may comprise openings 50, or handles, or the like, for easily lifting it off the plate.

The top or bottom plate and insert 5 will form a space where additional goods can be stored, such as papers, labels, instructions for use, service products, such as tape, glue, metal parts etc. This space can be designed weather- or waterproof or even airtight.

The space formed by the top plate 3 and the insert 5 can also be accessible from the top by transforming the cap on the top plate 3 into a lid and e.g. providing it with a hinge and sealing items.

The grooves and protrusions—31,41,42 see FIG. 1; 33,43 see FIG. 2—are intended to stabilize the stack, but also the single packaging system 1 acting as reinforcing ribs. They can be of round or rectangular shape, with parallel walls or preferably showing slight cone shape to provide better sliding of one piece (plate) into or onto the other. FIG. 5 shows a possible basic embodiment of a groove/protrusion configuration.

FIG. 6 schematically shows other embodiments of the configuration: e.g. FIG. 6*a* demonstrates that the rim 30 of the top plate 3 can be designed as an extended rim 30*b* to provide an outer guide for the rim 40 of the bottom plate 4. The inner walls of the rims can also be extended for higher stability and better guiding 30*a*,40*a*. FIG. 6*b* shows in addition that also inner walls—e.g. 30*a*—can be extended to form a rib 30*c*. The inner walls 30*a*,40*a* being longer than the outer rims 40,30 resulting in a virtual declination 49—see FIG. 6*a*—provide improved weather resistance, as water could not penetrate even when the packaging 1 is exposed to heavy rain and would show no sealed rim/foil gap. This would mean in practice, that even an already opened packaging would still be rainproof if just being assembled again.

The insulation material 6 to be packaged or wrapped or stored can be rigid or compressible. Some benefits of the packaging can only be applied on compressible materials (see below), however, the ventilation is beneficial for all kinds of material. The insulation material 6 can be of lamellar (mat-like) or tubular or any other shape, and can be placed horizontally or vertically into the packaging 1. Vertical placing is preferred for tubular shape materials, such as rolled mats or tubes. Separating materials, such as paper, tissue etc. can be placed between the layers of individual articles of the insulation material 6, as well as additional individual wrappings or packaging can be applied. The insulation material 6 can be packed into the foil 2 tightly or loosely, if necessary also leaving space in the center of the packaging for optimized ventilation (see e.g. FIGS. 3 and 4). The insulation material 6 can also be packed into the foil 2 in individual packaging, see FIG. 9. Different insulation materials 6 may also be packed together into the foil 2, see FIG. 9*c*.

The packaging 1 comprises according to one embodiment a handle 71, see FIG. 7 and FIG. 8, which is preferably foldable or retractable and which can be applied on the top of the top plate 3—preferably retractable into a groove not to disturb the ventilation process—or at the side of the packaging, e.g. welded, glued or riveted into the overlap of the foil 2 by means of connections 7 or 8. The handle 71 can also be formed in a way that at a part of the outer overlap 7 of the foil 2 is rolled back/anti-clockwise to its original rolling direction and fixed in rolled state, e.g. by adhesion spots 8, creating a handle bar 72. Optionally, the handle bar comprises openings 75 that can e.g. be punched through the remaining not rolled overlap 7 to obtain a better grip, see FIG. 11.

For special purposes and highest possible versatility at least the insert 5 or any other part of the top plate 3 and/or the bottom plate 4 can be designed in a way that tightly to loosely fixing tubular shaped insulation material 6—e.g. mat rolls or tubes—is achieved, e.g. to prevent it from moving or getting damage during transport, see FIG. 10 *a,b*. For fixing the tubular shaped insulation material 6 cone extensions 53 and/or cylindrical extensions 54—if required in stepped cone form 54*a*—of the insert 5—which may show an enlarged base plate 52 to host a larger number of extensions—will protrude into the opening of the tubular shape material at least from the top, but may also protrude from the bottom, e.g. from an inlay plate or an extension of the bottom plate 4. Such configuration is very beneficial for storing and transporting sensitive insulation materials 6, such as foamed glass or elastomeric foam. The tubular shape insulation materials can even be packaged as single items, which makes a lot of sense e.g. for big foamed glass shells and half shells and for large diameter elastomeric tubes.

To render the packaging optimally versatile for this purpose it is necessary to swiftly adapt the size of the plates 3,4 to the desired diameter of the packaging. Using the top plate 3 as example, FIG. 10 *c* shows how this is achieved by using extended flaps 55 of the plate which show grooves and/or indentations and/or hinges 56 in the respective intervals and which then can be attached to the packaging diameter by simply bending the flaps and the fixing the excess length to the foil 2 as described above for rims 30 or flaps 32. To ensure weatherability, the flaps 55 can be arranged in a shingle like manner or possible gaps can be sealed by tape etc.

For ensuring higher stability of the packaging, instead of using flaps the top plate 3 and/or the bottom plate 4 may show grooves and/or rims 31,33,41,42,43 in the respective intervals. Excess length then can be cut off, facilitated by weakening or embossing the plate on the outer next to a rim or groove.

For bearing even very heavy loads when stacked the packaging system 1 can comprise reinforcing structures inside the foil 2, such as cylindrical or cone or rectangular or star shape columns 20, see FIGS. 2*a*, 3, 11 and 12, which show further reinforcing structures 21, see FIG. 2*a*, and/or ventilation openings 25, see FIG. 3. The reinforcing structures 20 can be hollow to enable to drain the central part of the top plate 3, see FIG. 12.

For desired stability, the foil 2 shows a minimum thickness of 100 micron, and the top plates 3 and bottom plates 4 show a thickness of at least 150 micron at their thinnest point.

Any of the packaging 1 component 2,3,4,5 can comprise additional layers, reinforcements, surface structures such as openings, grooves, slots; or printings or labels or any of the combinations thereof.

The packaging system 1 itself can be wrapped again with tape, foil or shrink-warp or be furnished with any other outer packaging to further protect the system and/or to bundle several packaging systems, e.g. on a pallet 9 for space-saving transport.

The foil 2 can be manufactured by calendaring, extrusion, film blowing etc., depending on the material. The plates 3,4 as well as some other parts, like the insert 5, handles 9, hinges 46 etc. can be manufactured by deep-drawing or casting/moulding processes, followed by embossing, (die-) cutting etc. The openings 35,45 can be obtained by die-cutting a pre-manufactured plate, or the can be obtained directly through respective mould construction in moulding process. Preferred are moulding and deep-drawing processes of plastics materials, especially preferred is a moulding process wherein the plates are manufactured in one step, comprising all declinations 37 and overhangs 38 as well as all openings 35,45. For achieving this, at least a four-part mould is required, optionally with a collapsing core for easier demoulding of the undercut inside the overhang 38. As one layer of the mould then would be opening transversally to the machine-tool axis, the openings 35,45 cannot be arranged entirely around the plates' circumference, as can be seen in FIGS. 7 and 8.

It is an advantage of the present invention that it is providing a weatherproof and reliable packaging system 1 that allows to store any insulation material 6 outdoors, which offers a big economic advantage to manufacturers, logistics services, dealers and users, as insulation materials are characterized by large volume in relation to weight, which means that storage space is always an issue, especially under roof.

It is a linked advantage of the present invention that it can be stacked saving even more space, without losing other benefits, such as ventilation performance.

It is therefore another advantage of the present invention that permanent and forced ventilation is provided, which on one hand helps to remove smell from the insulation material 6 e.g. created by manufacturing; and one the other hand prevents humidification or mould and fungus growth.

It is a further advantage of the present invention that it is lightweight, but same time robust, and therefore not only saves space, but also energy during transport. It can be carried by hand to the place where the insulation 6 is needed without risking contaminating or damaging the insulation 6. Using this benefit, one can even handle, store and transport brittle materials (like foamed glass or PIR) or compressible materials (like elastomeric foam) without taking special precautions.

It is another advantage of the present invention that the packaging is very versatile in size, volume, geometry and material, and therefore can be used for wrapping any insulation material, such as fibres (mineral, glass, felt, coconut fiber, hemp etc.), duromerics (polyurethanes/PUR/PIR, melamines, phenolics etc.), elastomerics (rubbers, TPEs), thermoplasts (polyolefins, technical thermoplasts etc.) and expanded metals or foamed glass.

It is another advantage of the present invention that geometry (i.e. the top view contour), width and height of the packaging can be adapted to 1) the insulation material 6 to be packaged (material, dimensions etc.) and 2) to the requirements for storage and transport (pallet size, container/truck shipping space etc.).

It is a linked advantage of the present invention that the versatility of the packaging system allows to store and transport the insulation material 6 in loose to very compressed state, depending on the material's properties. Using this advantage, one can e.g. allow or prevent shrinkage of insulation materials and thus prevent warping or uneven shrinkage. For example, expanded polymeric material, such as polyethylene or elastomeric mats, tend to shrink more where there is less friction when packaged; with the consequence that the outer windings of rolled mats will shrink significantly more than the inside, and that the outer rim of stacked mats will shrink more than the center part where there is higher pressure and thus more friction hampering contraction. A slight compression by the foil 2 of the packaging 1 could prevent this uneven shrinkage by applying the same compression and thus friction ratio over the entire mat roll.

The fact that the packing system 1 is reusable if being reassembled and/or recyclable if manufactured from e.g. recyclable plastics is another advantage of the present invention.

It is a linked advantage of the present invention that in case it is completely disassembled it can be stored away easily occupying only minimum space, as the plates 3,4 can be stacked and the foils 2 can be rolled, folded or simply laid on top of each other.

In this context it is another advantage of the present invention that it can be easily opened and closed both by packaging machines but also by the end user.

It is an advantage of the present invention that it can be produced by standard methods, like foil extrusion/blowing, casting, deep-drawing, moulding etc. in a very economical way.

It is a further advantage of the present invention that insulation materials 6 can be individually wrapped and fixed using parallel wall, cone or reverse cone geometry of the foil 2, respectively.

It is also an advantage of the present invention that the packaging can be opened easily, by opening the foil 2 or removing top or bottom plate 3,4, (e.g. by tearing at handles 71,72), and that individually packaged parts can be withdrawn without complete removal of the foil or plates.

All publications and patent applications referred to herein are incorporated by reference in their entirety as if each individual publication or patent application were specifically and individually set forth herein.

The invention claimed is:

1. A weatherproof packaging system for encasing, protecting, stacking, storing and transporting insulation material comprising:

at least one sheet-like mantle, preferably a foil which is especially preferred exhibiting elastic properties, at least one top plate and at least one bottom plate, wherein the top plate comprises a protrusion and the bottom plate comprises a groove so that the bottom plate of the packaging system can be fit into a second top plate of a second packaging system by fitting the groove of the packaging system into a second protrusion of the second packaging system, resulting in a stable stack, and wherein the top plate and the bottom plate comprise a rim to be attached to an outer surface of the mantle in order to guide, fix and stabilize the mantle horizontally and vertically, and where at least the top plate comprises a declination descending to an outer periphery of the top plate.

2. The weatherproof packaging system according to claim 1, wherein the top plate and the bottom plate comprise openings to provide forced ventilation of an inside of the packaging system, and where the openings in the top plate and in the bottom plate are arranged in a way that they will not be blocked, but are always neighboured so as to ensure ventilation when two or more packaging systems are stacked.

3. The weatherproof packaging system according to claim 1, wherein the mantle and top and bottom plates are connected by adhesives, mechanical connection or welding to form a closed packaging system.

4. The weatherproof packaging system according to claim 1, wherein an outer contour is cylindrical or of cone or of reverse cone shape.

5. The weatherproof packaging system according to claim 1, wherein a material for the mantle and top and bottom plates is chosen from massive and/or expanded recyclable materials.

6. The weatherproof packaging system according to claim 5, wherein the material for the mantle and top and bottom plates is chosen from massive and/or expanded thermoplasts.

7. The weatherproof packaging system according to claim 5, wherein the material for the mantle and top and bottom plates is chosen from the group consisting of massive and/or expanded polyolefins, thermoplastic biopolymers, and polyalkylidene terephthalates.

8. The weatherproof packaging system according to claim 1, wherein at least the top plate has a declination by dome shape, as well distance keepers on top to ensure a gap between two packaging systems when packaging systems (1) are stacked.

9. The weatherproof packaging system according to claim 1, wherein an insert is arranged at least on a side of the top plate facing the interior of the packaging system.

10. The weatherproof packaging system according to claim 9, wherein printed media is arranged into a closed space created by the insert.

11. The weatherproof packaging system according to claim 9, wherein adhesive products for insulation materials are arranged into a closed space created by the insert.

12. The weatherproof packaging system according to claim 1, which comprises a handle and/or handle bar.

13. The weatherproof packaging system according to claim 1, wherein the mantle has a minimum thickness of 100 micron and the top plate and/or bottom plate has a thickness of at least 150 micron at their thinnest point, and where a maximum thickness of the mantle is 5 mm and a maximum thickness of top and/or bottom plates is 10 mm.

14. The weatherproof packaging system according to claim 1, in combination with an insulation material, wherein the mantle is pressed against the insulation material.

* * * * *